US011014743B2

(12) United States Patent
Valerga

(10) Patent No.: US 11,014,743 B2
(45) Date of Patent: May 25, 2021

(54) REFUSE BIN WITH INFLATABLE LIFT

(71) Applicant: George G. Valerga, Camino, CA (US)

(72) Inventor: George G. Valerga, Camino, CA (US)

( * ) Notice: Subject to any disclaimer, the term of this patent is extended or adjusted under 35 U.S.C. 154(b) by 24 days.

(21) Appl. No.: 16/267,265

(22) Filed: Feb. 4, 2019

(65) Prior Publication Data

US 2020/0247607 A1 Aug. 6, 2020

(51) Int. Cl.

| | |
|---|---|
| ***B65F 1/06*** | (2006.01) |
| ***B66F 11/00*** | (2006.01) |
| ***B65F 1/12*** | (2006.01) |
| *B66F 19/00* | (2006.01) |

(52) U.S. Cl.

CPC ..... *B65F 1/068* (2013.01); *B65F 1/12* (2013.01); *B66F 11/00* (2013.01); *B66F 19/00* (2013.01); *B66F 2700/09* (2013.01)

(58) Field of Classification Search

CPC .. B65F 1/068; B65F 1/12; B66F 11/00; B66F 19/00; B66F 2700/09

USPC ..... 220/495.06

See application file for complete search history.

(56) References Cited

U.S. PATENT DOCUMENTS 3,031,092 A * 4/1962 Maskel ..... B66F 9/02 414/416.09
3,556,186 A * 1/1971 Gerard Besthorne . B65D 31/00 383/3
3,742,994 A * 7/1973 Pensak ..... B65D 31/04 383/3
RE30,374 E * 8/1980 Spencer ..... B65D 19/14 206/522
4,715,572 A * 12/1987 Robbins, III ..... B65F 1/06 220/495.04
5,316,170 A * 5/1994 Brown ..... B65F 1/068 220/495.06
5,685,688 A * 11/1997 Podd ..... B60P 1/00 220/1.6
8,357,414 B2 * 1/2013 Becraft ..... A23B 4/16 206/522
9,248,963 B2 * 2/2016 Warren ..... B65F 1/0006
2003/0006162 A1 * 1/2003 Smith ..... B65D 81/027 206/522
2006/0078412 A1 * 4/2006 Hagemann ..... B65D 88/60 414/467
2009/0255934 A1 * 10/2009 Herndon ..... B65F 1/068 220/495.04

* cited by examiner

*Primary Examiner* — J. Gregory Pickett
*Assistant Examiner* — Niki M Eloshway
(74) *Attorney, Agent, or Firm* — David T. Millers

(57) ABSTRACT

A refuse bin includes a liner sealed to a container. An inflatable space is between the liner and the container, and an inlet to the inflatable space conducts a flow to inflate the inflatable space from a deflated state to an inflated state. In the deflated state, the liner lines a cavity for refuse in the container. In the inflated state, the liner extends above the open end of the container. The flow into the inlet pushes the inflatable space toward the inflated state causing the liner to lift the refuse. The refuse bin may further include a lid-lifting mechanism activation by inflation of the inflatable space or an insert that helps shape the liner in the inflated state.

10 Claims, 6 Drawing Sheets

REFUSE BIN WITH INFLATABLE LIFT

BACKGROUND

People are often injured when lifting heavy objects. For example, discarding a heavy item may require a person to lift the item to near head height when discarding the item into a tall or commercial garbage bin. Such lifting may cause injuries.

In the janitorial business, in particular, janitors commonly employ mobile garbage cans that may be filled with refuse while the garbage cans are moved around sites being serviced. Such mobile garbage cans with accumulated refuse may regularly need to be moved to a larger garbage bin into which the refuse is transferred. Large or commercial bins are often taller than mobile garbage cans, and a worker may need to reach into a mobile garbage can and lift a bag containing the collected refuse from the can to a height above the level of the edge of the larger bin in order to drop the refuse in the larger bin. The lifting and the awkwardness of the maneuver may cause injuries.

SUMMARY

In accordance with an aspect of the invention, a mobile container such as a refuse bin contains a liner sealed to the container with an inflatable space between the container and the liner. Refuse may be collected in the container, particularly in a depression surrounded by the liner. An inlet to the inflatable space allows an inflation device to pump or push a flow of air or another gas into the inflatable space, causing the liner to push upward and inflate like a bladder. As the flow fills the space between the container and the liner, the liner raises or lifts the contents that are in the mobile container to a height at which the contents may be easily accessed. In particular, inflation may lift the contents from the interior of the container to a location near or above the edge of a commercial garbage bin where the contents from the container may be pushed or guided into the commercial bin. In other circumstances, the bladder may be used to lift the refuse out of the container, so that the refuse may be lowered to ground level or transferred to a mobile cart.

In some implementations, a lid-lifting mechanism may be mounted on the refuse container. The lid-lifting mechanism may include an extension, lever, or chute adapted to contact and or attach to the lid of a commercial garbage bin. As the liner is inflated to lift collected refuse, the liner also pushes the lid-lifting mechanism, which raises the lid of the commercial bin. The collected refuse may then be pushed into the commercial bin, without the need for a worker to manually lift the collected refuse or manually raise the lid of the commercial bin.

In some implementations, a movable insert may be used in the refuse container, and the liner may be between the insert and the interior of the refuse container. The insert may be generally cylindrical and sized to nest within the refuse bin. When the liner is inflated, part of the liner lifts the insert, and another part of the liner lifts the collected refuse and extends up through the insert. The insert can thus control the shape of the liner as the liner lifts refuse.

BRIEF DESCRIPTION OF THE DRAWINGS

The drawings illustrate examples for the purpose of explanation and are not of the invention itself. Use of the same reference symbols in different figures indicates similar or identical items.

DETAILED DESCRIPTION

A refuse bin may include a container and a liner that is sealed to the container with an inflatable space between the container and the liner. The seal may be airtight or may allow a sufficiently small leakage so that air supplied, pumped, or pushed through an inlet into the inflatable space expands or inflates a bladder formed by the liner and the container. Inflation of the bladder lifts the contents of the container, e.g., lifts a trash bag containing collected refuse to a height near or above the lip of a commercial garbage bin, so that manual lifting of the contents is avoided. For example, inflation may lift the contents from the refuse bin to a height where the contents may be pushed into a commercial garbage bin. Alternatively, inflation may lift the refuse to the top of the container, so that the refuse may be lowered to ground level or transferred to a mobile cart.

Figure 1A:
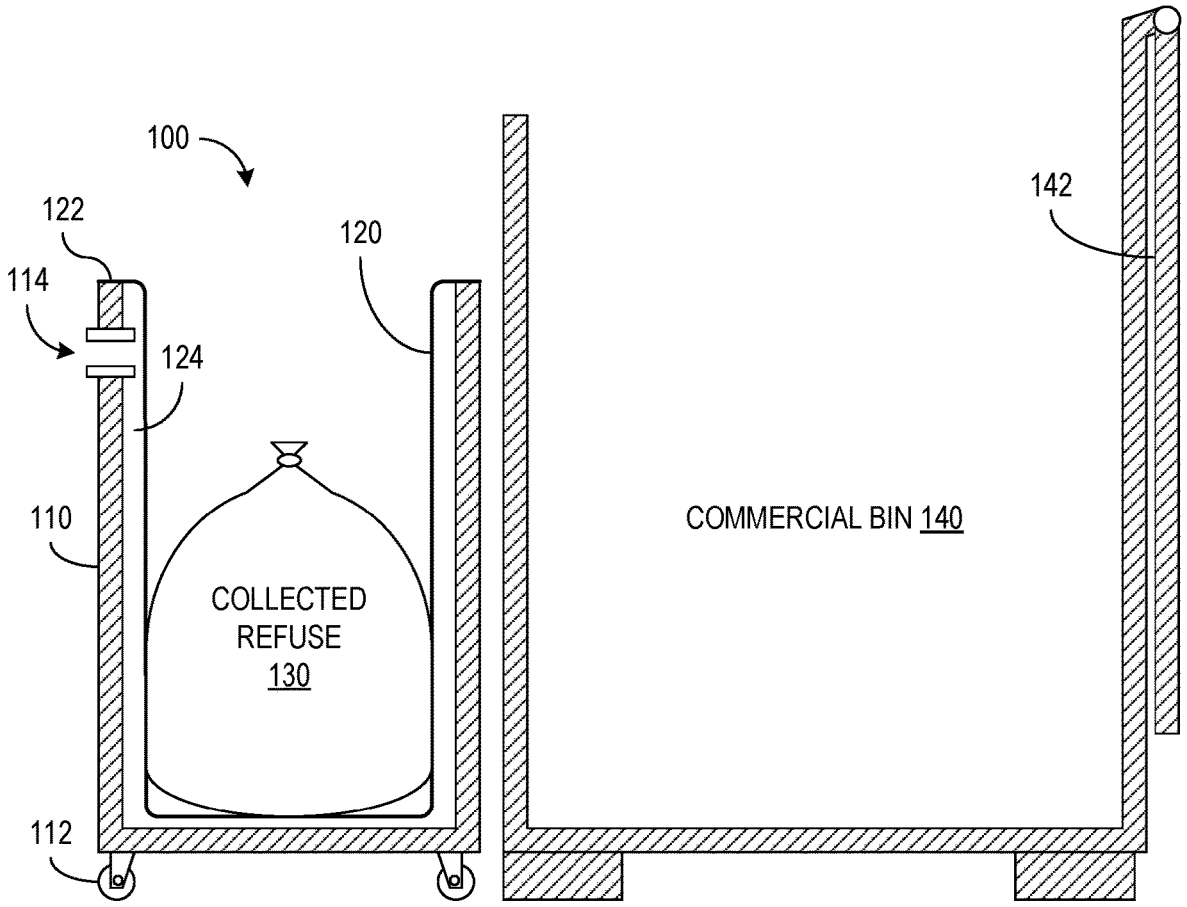
FIG. 1A shows one implementation of a refuse bin with an inflatable lift in a deflated state.

FIG. 1A shows one implementation of refuse bin 100 in accordance with an example implementation. Refuse bin 100 includes a container 110 with a liner 120 that is sealed to container 110. In one implementation, container 110 is a generally cylindrical or cup-shaped plastic garbage can that may be used to collect refuse 130. For example, when an inflatable space 124 between container 110 and liner 120 is in a deflated state shown in FIG. 1A, collected refuse 130 may be inside container 110 in a cavity formed by liner 120. For example, a disposable garbage bag may line the interior of liner 120, be filled with discarded items, and then tied off to contain collected refuse 130 as shown in FIG. 1A. Refuse bin 100 may be mobile, e.g., having wheels or rollers 112 on container 110, and FIG. 1A shows refuse bin 100 after refuse bin 100 has been moved adjacent to a larger bin 140, such as a commercial garbage bin. Bin 140 may be significantly taller than refuse bin 100, e.g., up to about twice as tall as bin 100. For example, bin 100 may be about 3 feet tall while bin 140 is about five feet tall. Bin 140 may or may not have a lid. FIG. 1A shows bin 140 with a lid 142 open.

Liner 120 may be made of a sheet material such as plastic sheeting, fabric, rubberized fabric, canvas, tarpaulin, or any similar flexible sheeting that is sufficiently sturdy and air tight. Liner 120 may further be shaped, e.g., molded or sewn, to conform with the interior of container 110, and a top portion of liner is attached and sealed to container 110. In particular, a seal 122 between liner 120 and container 110 may be around the inside of container 110, at the top of container 110, or around the outside of container 110. Liner 120 being sealed on container 110 creates inflatable space 124 between liner 120 and the interior of container 110. As described further below, seal 122 may be reasonably air tight up to pressures sufficient to expand an inflatable space 124 and lift collected refuse 130. Inflatable space 124 may thus be sealed, except for an inlet 114. Inlet 114 to inflatable space 124 may be provided in container 110 as shown in FIG. 1A or alternatively through liner 120, so that air may be pumped into inflatable space 124. FIG. 1A shows air space 124 in deflated state, where the pressure in space 124 is equal to the surrounding air pressure and liner 120 may be up against the interior of container 110.

Figure 1B:
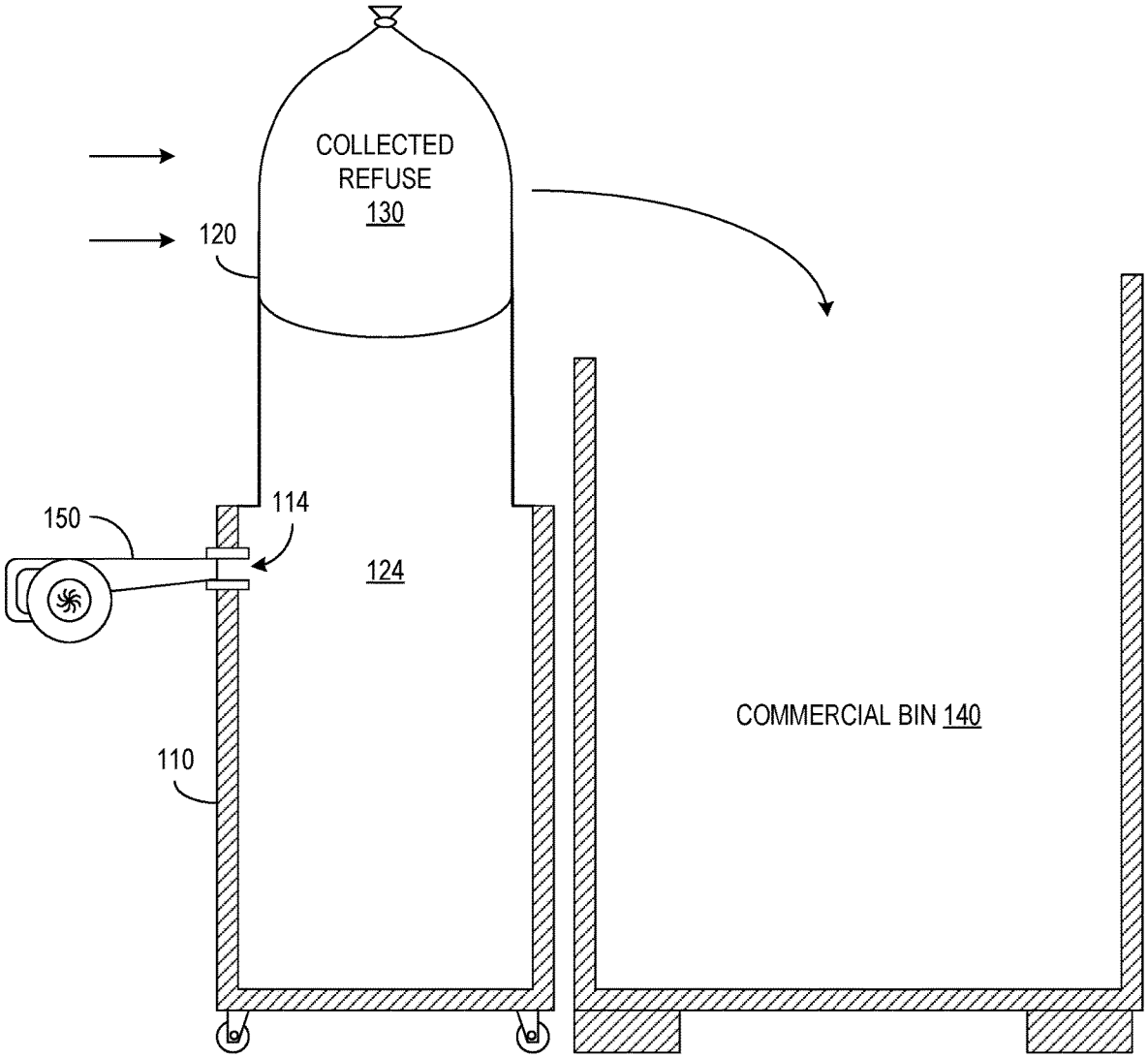
FIG. 1B shows the refuse bin of FIG. 1A when the inflatable lift is inflated to a height where refuse may be pushed over the side of a taller bin.

FIG. 1B shows an inflation device 150 that may be inserted through or fit to inlet 114 to provide an air flow that inflates and expands the space 124. Inflation device 150 may be a motorized leaf blower, a floor vacuum, or another device that may be commonly available for other purposes such as gardening or janitorial services and is able to provide a sufficient air flow. For example, the hose of a tank-type vacuum or the end of a leaf blower may be snuggly fit into inlet 114 to push air pressure and/or an air flow into space 124 and inflate liner 120. Alternatively, inflation device 150 may be integrated into refuse bin 100. For example, inflation device 150 may be a motorized or a manually-operated air pump, that is part of bin 100 and is used to inflate air space 124.

FIG. 1B shows air space 124 in an inflated state. As shown, inflation causes liner 120 to push out of container 110 and lift collected refuse 130 to a height near or above the lip of bin 140. Collected refuse 130 may then be easily guided, pushed, or slid into bin 140 without requiring manual lifting of refuse 130. Liner 120 in the inflated state may be at least somewhat flexible allowing the top of the inflated liner 120 to be pushed against container 140 to facilitate transfer of collected refuse 130 to bin 140.

Figure 2A:
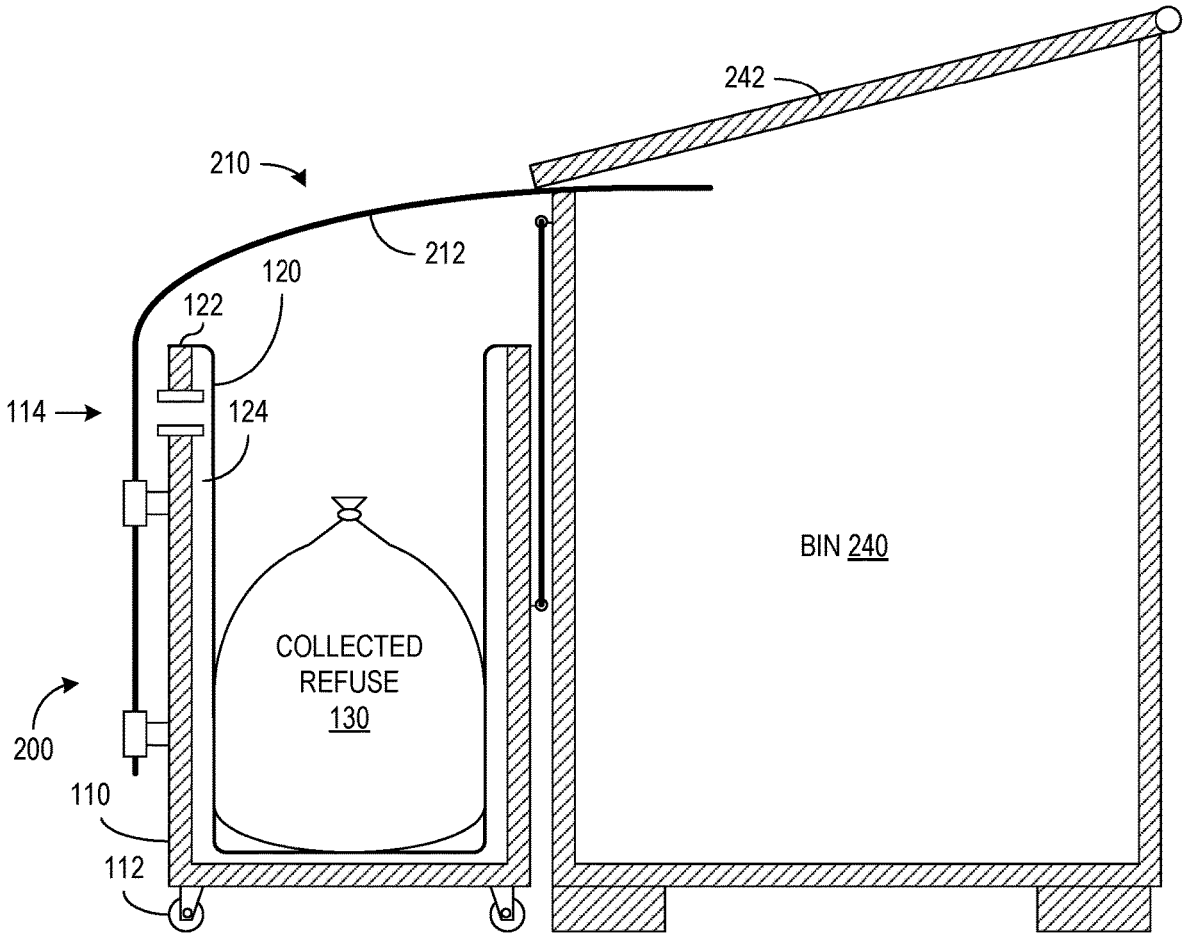
FIG. 2A shows a tall bin with a lid and one implementation of a refuse bin with a lifting mechanism attached to a container and inserted under the lid of the tall bin.

FIG. 2A shows a refuse bin 200 in accordance with an implementation that may be used to lift collected refuse 130 and lift a lid 242 of a larger collection bin 240, e.g. a lidded commercial garbage bin. FIG. 2A shows lid 242 as nearly closed. Refuse bin 200 may be substantially the same as bin 100 of FIGS. 1A and 1B described above, but refuse bin 200 further includes a lid-lifting mechanism 210 that may be attached to container 110 or liner 120 and used to lift lid 242.

In the embodiment of FIG. 2A, lid-lifting mechanism 210 includes one or more extensions or lifting levers 212. Each lifting lever 212 has a lower portion attached to container 110 and an upper portion that may be positioned to extend above container 110. The tip of each lifting lever 212 may be shaped for insertion under lid 242 of bin 240. Alternatively, the upper portion of each lifting lever 212 may have structure for attachment to lid 242. Lifting lever 212 may be flexible or hinged so that the operation of inflating liner 120 can tilt the upper portion of lifting lever 212 up and thereby lift lid 242.

Figure 2B:
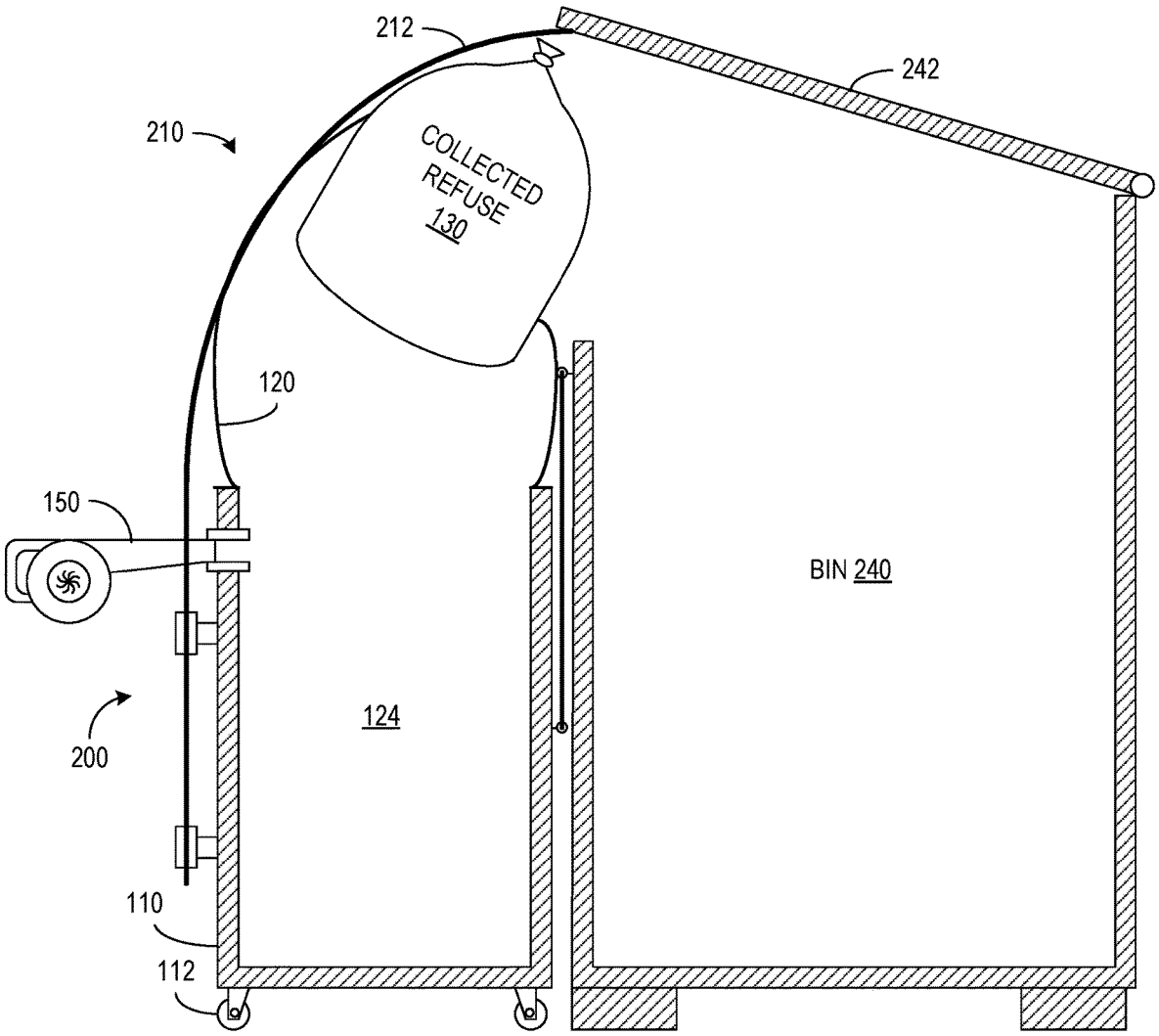
FIG. 2B shows the refuse bin of FIG. 2A when the inflatable lift is inflated so that the inflatable lift pushes the lifting mechanism to lift the lid of the tall bin.

FIG. 2B shows bin 200 after an inflation device 150 is operated to inflate inflatable space 124 enough to lift lid 242. A strap may be used to attach container 110 to bin 240, e.g., using an eye hook on bin 240, so that container 110 does not slide away from bin 240 during the inflation process. FIG. 2B also shows a level of inflation in which collected refuse 130 is lifted to above the lip of bin 240. The inflation of inflatable space 124 further lifts the upper portion of lifting lever 212, causing lifting mechanism 210 to lift lid 242. With refuse 130 near or above the lip of bin 240 and lid 242 opened enough, refuse 130 can be pushed into taller bin 240.

Lid-lifting mechanism 210 may be constructed of a rigid material such as rigid plastic or metal with a hinge between the upper and lower portions of each lifting lever 212 or may be sufficiently flexible to flex between the shapes shown in FIGS. 2A and 2B. In some alternative embodiments, lid-lifting mechanism 210 may further include a chute or tube having a diameter about the size of the diameter of container 110 or larger. The chute may be used to help guide refuse 130 into bin 240 when or after lid-lifting mechanism 210 sufficiently lifts lid 242. The chute may be made of a flexible material such as fabric, canvas, tarpaulin, rubberized fabric, or plastic or other sheeting.

Figure 3A:
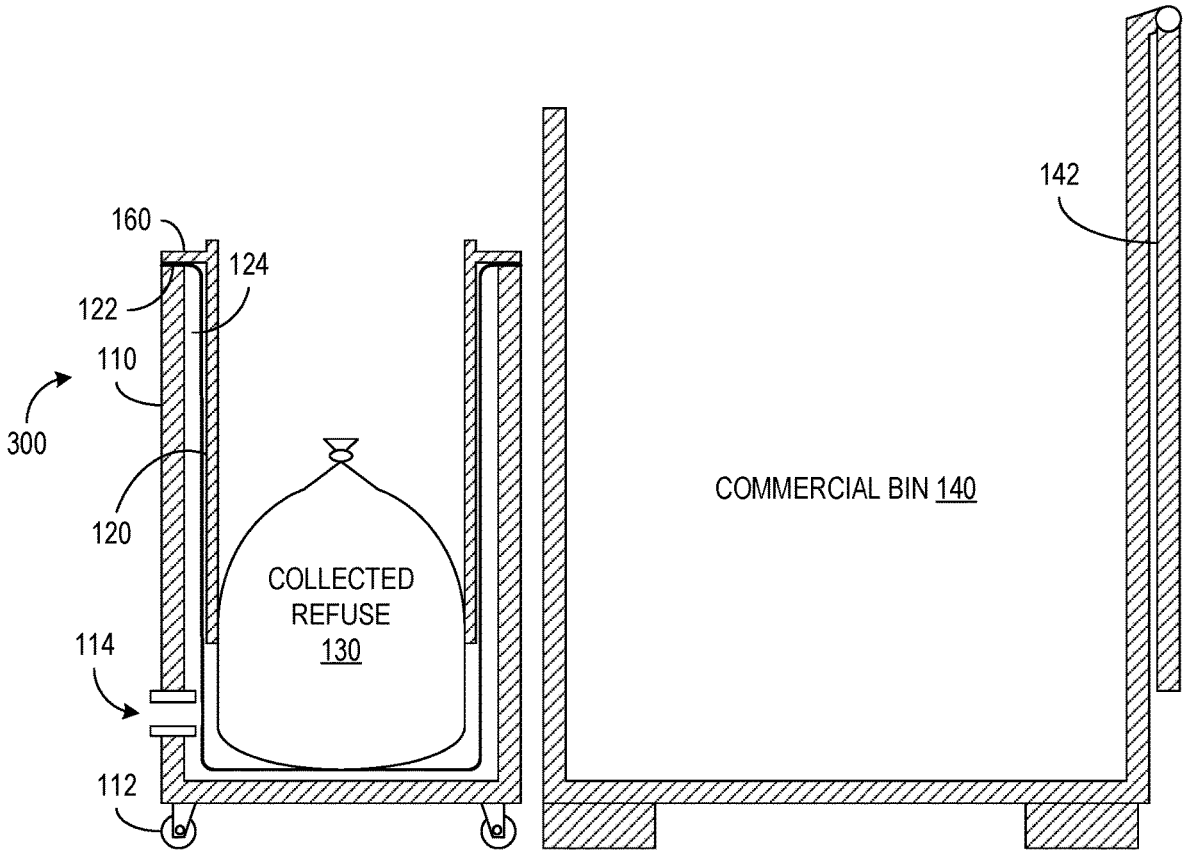
FIG. 3A shows an implementation of a refuse bin with an insert and an inflatable liner in a deflated state.

FIG. 3A shows a refuse bin 300 that may have components substantially identical to those of refuse bin 100, but refuse bin 300 additionally employs an insert 160 that may be free floating or removable from container 110. Insert 160 may be a plastic or other light weight tube that is sized or shaped to nest in container 110 with liner 120 between insert 160 and container 110. In particular, insert 160 may be generally cylindrical when container is generally cylindrical. More generally, insert 160 may be similar in shape and construction to container 110. Unlike container 110, insert 160 does not have a closed bottom, allowing liner 120 to push refuse 130 through insert 160 during inflation. Insert 160 in the embodiment shown has a lip that rests on the top lip of container 110, and insert 160 has a height that is shorter than the depth of the interior of container 110. The height of insert 160 may be adjusted based on or to limit the fully inflated height of liner 120.

Figure 3B:
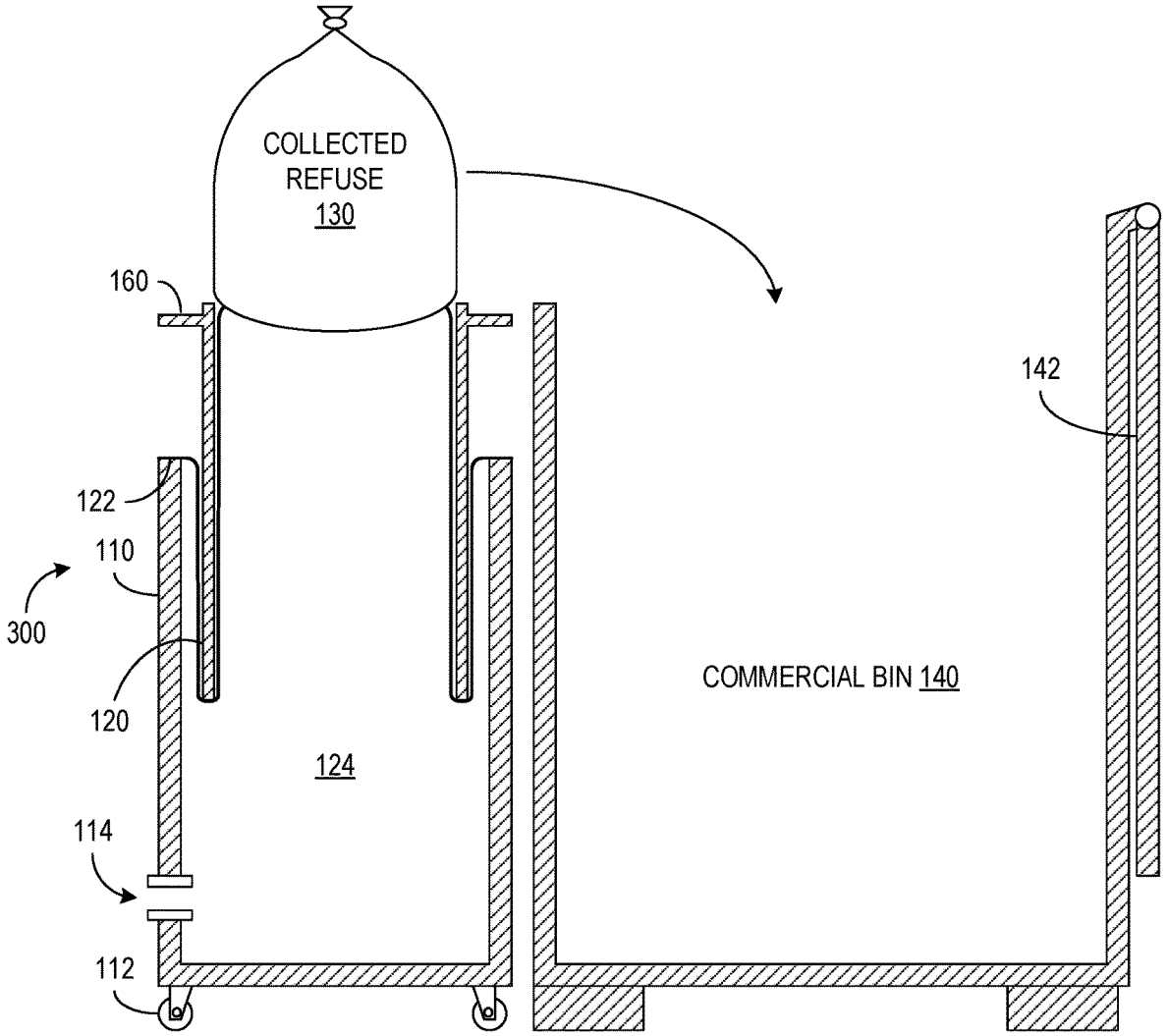
FIG. 3B shows the refuse bin of FIG. 3A when the inflatable lift is inflated to a height where refuse may be pushed over the side of a taller bin and the insert guides and shapes the inflatable liner.

FIG. 3B shows refuse can 300 in a fully inflated state at which inflation has pushed liner 124 and collected refuse 130 through insert 160, so that collected refuse 130 is at the top of insert 160. Inflation of space 124 has also lifted insert 160 and collected refuse 130, so that collected refuse 130 may be pushed into bin 140 without manual lifting. An advantage of using insert 160 is that insert 160 may be more rigid than liner 120 and thus may control the shape of liner 120 when liner 120 is inflated and may provide a more stable or rigid platform for collected refuse 130.

Although particular implementations have been disclosed, these implementations are only examples and should not be taken as limitations. Various adaptations and combinations of features of the implementations disclosed are within the scope of the following claims.

What is claimed is:

1. A refuse bin comprising:

a container;

a liner sealed to the container, the liner and the container defining an inflatable space between the liner and the container, the inflatable space having a deflated state in which the liner lines a refuse cavity in the container and having an inflated state in which the liner extends above a top opening of the container;

an inlet to the inflatable space, the inlet being sized to a flow that inflates the inflatable space from the deflated state to the inflated state; and a lid-lifting mechanism attached to the container and having an end shaped to engage a lid of a second bin that is taller than the refuse bin, the lid-lifting mechanism being positioned so that inflation of the inflatable space causes the liner to push up on the end of the lid-lifting mechanism.

2. The refuse bin of claim 1, further comprising an air flow device coupled to the inlet, the air flow device being operable to produce the flow that inflates the inflatable space.

3. The refuse bin of claim 2, wherein the air flow device is selected from a group consisting of a leaf blower, a vacuum cleaner, and a pump.

4. A refuse bin comprising:

a container;

a liner sealed to the container, the liner and the container defining an inflatable space between the liner and the container, the inflatable space having a deflated state in which the liner lines a refuse cavity in the container and having an inflated state in which the liner extends above a top opening of the container;

an inlet to the inflatable space, the inlet being sized to a flow that inflates the inflatable space from the deflated state to the inflated state; and a tubular insert nested in the container, the liner being between the tubular insert and the container in the deflated state, and the liner lifting the tubular insert and extending through the tubular insert in the inflated state.

5. The refuse bin of claim 4, further comprising wheels or rollers on the container.

6. The refuse bin of claim 4, wherein the inlet extends through a sidewall of the container and is sized for connection to a leaf blower or floor vacuum that provides the flow that inflates the inflatable space.

7. The refuse bin of claim 4, wherein the refuse bin is shorter than a commercial bin, and in the inflated state, the liner extends above the container to a height of the commercial bin.

8. A method comprising:

placing an item in a space inside a container lined by a liner;

placing an extension that is attached to the container in contact with a lid of a second container;

driving a flow into a space between the liner and the container, the flow inflating the space and causing the liner to extend out of a top opening of the container and thereby lift the item out of the container, wherein driving the flow also lifts the extension causing the extension to open the lid of the second container.

9. A method comprising:

placing an item in a space inside a container lined by a liner;

placing a tubular insert in the container with the liner being between the tubular insert and the container:

driving a flow into a space between the liner and the container, the flow inflating the space and causing the liner to extend out of a top opening of the container and thereby lift the item out of the container, wherein driving the flow also lifts the tubular insert and pushes the item and a portion of the liner through the tubular insert.

10. The method of claim 9, wherein:

the item is refuse collected in the container;

inflating the space lifts the refuse to a first height near a lip of a second container; and the method further comprises transferring the refuse from the first height over the lip of the second container and into the second container.

* * * * *